US006148454A

United States Patent [19]

Ball

[11] Patent Number: 6,148,454

[45] Date of Patent: Nov. 21, 2000

[54] SOLENOID CONTROL FOR A BATHTUB WASTE WATER DRAIN

[75] Inventor: William T. Ball, Leawood, Kans.

[73] Assignee: WCM Industries, Inc., Colorado Springs, Colo.

[21] Appl. No.: 09/262,541

[22] Filed: Mar. 4, 1999

[51] Int. Cl.[7] ..... E03C 1/232

[52] U.S. Cl. ..... 4/683

[58] Field of Search ..... 4/682–684, 688, 4/669

[56] References Cited

U.S. PATENT DOCUMENTS

| | | | |
|---|---|---|---|
| 2,180,790 | 11/1939 | Brummett | 4/669 |
| 4,042,984 | 8/1977 | Butler | 4/570 X |
| 4,352,213 | 10/1982 | Watts | 4/683 |
| 4,910,807 | 3/1990 | Willis | 4/683 |
| 4,945,579 | 8/1990 | Husting | 4/688 |

*Primary Examiner*—Charles E. Phillips
*Attorney, Agent, or Firm*—Zarley, McKee, Thomte, Voorhees & Sease

[57] ABSTRACT

A control for a waste water drain in the bottom of a bathtub which has an overflow port above the drain in the end wall of the bathtub has a vertical drain pipe having upper and lower ends. A first fluid port is located at the upper end of the vertical drain pipe and a second fluid port is located below the first fluid port for connection to a bathtub waste water drain. A valve element is slidably mounted in the vertical drain pipe adjacent the second port and is movable between a lower position to close the second port to fluid flow, and an upper position which will open the second fluid port to fluid flow. An electrical solenoid is mounted adjacent the first port. An elongated linkage connects the valve element to the plunger of the solenoid so that the movement of the plunger in one direction will raise the valve element to the upper position, and movement of the plunger in the opposite direction will lower the valve element to the lower position. The vertical drain pipe is length-adjustable.

19 Claims, 3 Drawing Sheets

SOLENOID CONTROL FOR A BATHTUB WASTE WATER DRAIN

BACKGROUND OF THE INVENTION

Bathtub drains commonly have a closure element therein which can open or close the drain by being lifted manually upward to open the drain or drop to an initial seating position to close the drain. While such drain closures work well, they are not greatly convenient by reason of their being located on the bottom of the tub where the drain is located.

Linkage systems do exist in at least lavatories or the like where the waste water drain is opened or closed through a linkage system wherein the operative mechanism is located above the bottom level of the basin. However, these are not easily adapted to the bathtub environment, and pose at least some problems in maintaining the cleanliness of the fixture around the exposed end of the linkage system where the closure is operated.

Variations in tub dimensions and the like sometimes make the adaptation of linkage systems difficult to install.

It is therefore a principal object of this invention to provide a control for a bathtub waste water drain which is easily accessible to the person using the tub.

A further object of this invention is to provide a control for a bathtub waste water drain which can be easily installed in spite of variations in the dimensions of the tub.

A still further object of the invention is to provide a control for a bathtub waste water drain which can be easily cleansed.

These and other objects will be apparent to those skilled in the art.

SUMMARY OF THE INVENTION

A control for a waste water drain in the bottom of a bathtub which has an overflow port above the drain in the end wall of the bathtub has a vertical drain pipe having upper and lower ends. A first fluid port is located at the upper end of the vertical drain pipe and a second fluid port is located below the first fluid port for connection to a bathtub waste water drain.

A valve element is slidably mounted in the vertical drain pipe adjacent the second port and is movable between a lower position to close the second port to fluid flow, and an upper position which will open the second fluid port to fluid flow.

An overflow cap is mounted adjacent the first port. An elongated linkage connects the valve element to a solenoid on the upper end of the drain pipe so that the movement of the solenoid plunger in one direction will raise the valve element to the upper position, and movement of the plunger in the opposite direction will lower the valve element to the lower position. The vertical drain pipe is link-adjustable.

DESCRIPTION OF THE PREFERRED EMBODIMENT

Figure 6:
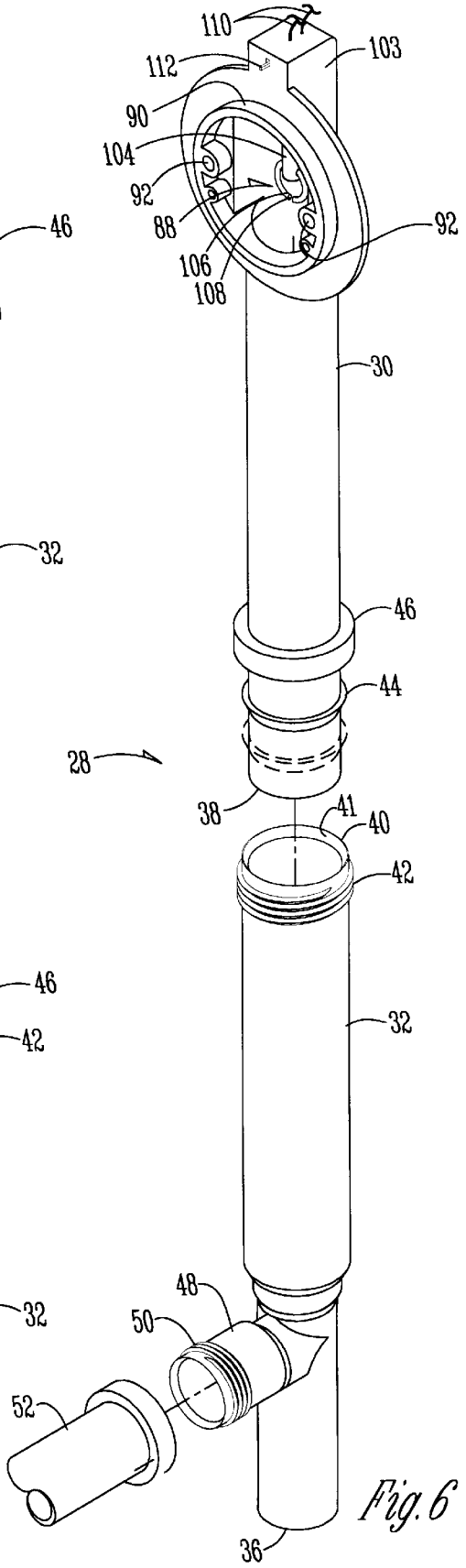
FIG. 6 is an exploded perspective view of the pipe components of the invention.

A bathtub ("tub") 10 is mounted adjacent bathroom end wall 12 and sidewall 14, and has a bottom 16, top end wall 18, and top sidewall 20. A conventional tub waste water drain outlet 22 is located in bottom 16. A conventional water control valve 24 and water outlet 26 are mounted on the end wall 12. With reference to FIG. 6, a vertical drain pipe 28 has an upper portion 30 and a lower portion 32, and an upper end 34 and a lower end 36. The lower end 38 of the upper portion 30 is insertable in the upper end 40 of the lower portion 32. It should be noted that the upper end 40 is tapered around its inner edge 41. Exterior threads 42 extend around the upper end 40.

A tapered plastic seal ring 44 is slidably mounted on upper portion 30 and has a tapered lower edge 45 which is compatible with the tapered inner edge 41 of the lower portion 32. A lock connector nut 46 is slidably mounted on upper portion 30. When the seal 44 is located in the desired position on upper portion 30, its lower end 38 is inserted into the upper end 40 of the lower portion 32 so that the seal ring 44 rests with its tapered surface 41 in engagement with the tapered surface 45 on the upper edge of the member 32. (See FIG. 5).

A waste water port 48 (FIGS. 6 and 7) is integrally formed with the lower portion 32 and extends horizontally outwardly from portion 32. The outer end of port 48 has external threads 54 thereon which can be detachably and threadably secured to horizontal waste water line 52 which is conventionally connected to the waste water drain 22 in tub 10.

Figure 1:
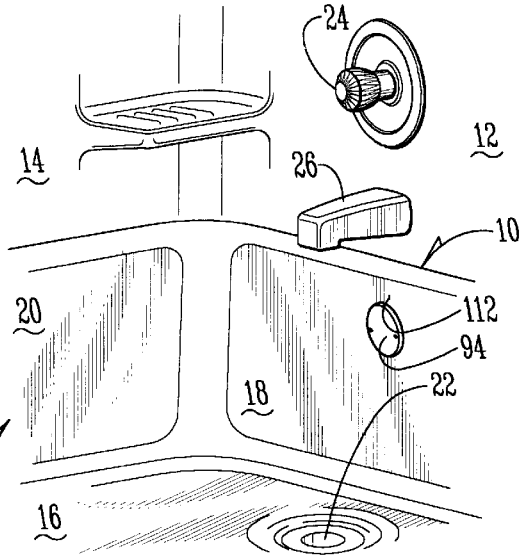
FIG. 1 is a partial perspective view of a tub having the waste water control of this invention.
Figure 2:
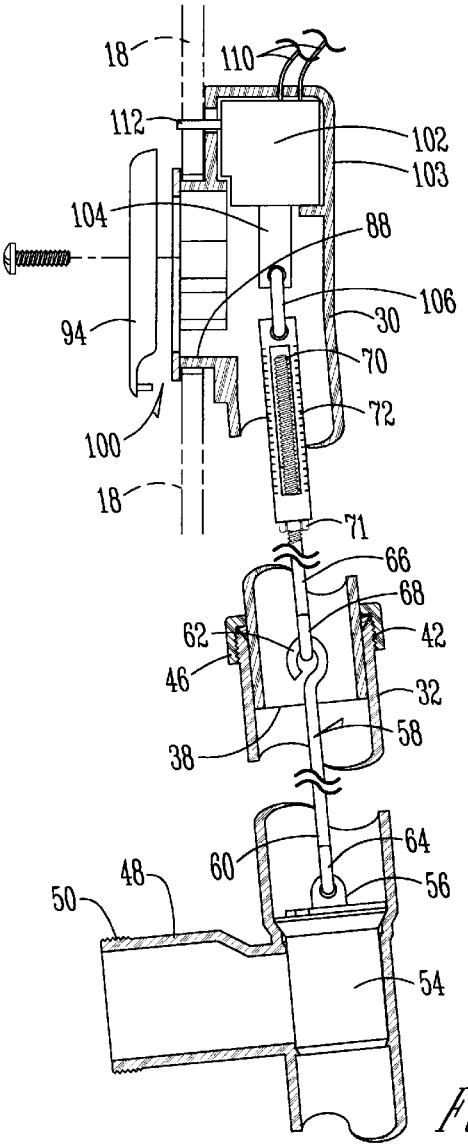
FIG. 2 is an enlarged scale sectional view of the device of this invention showing the valve in the closed condition.
Figure 3:
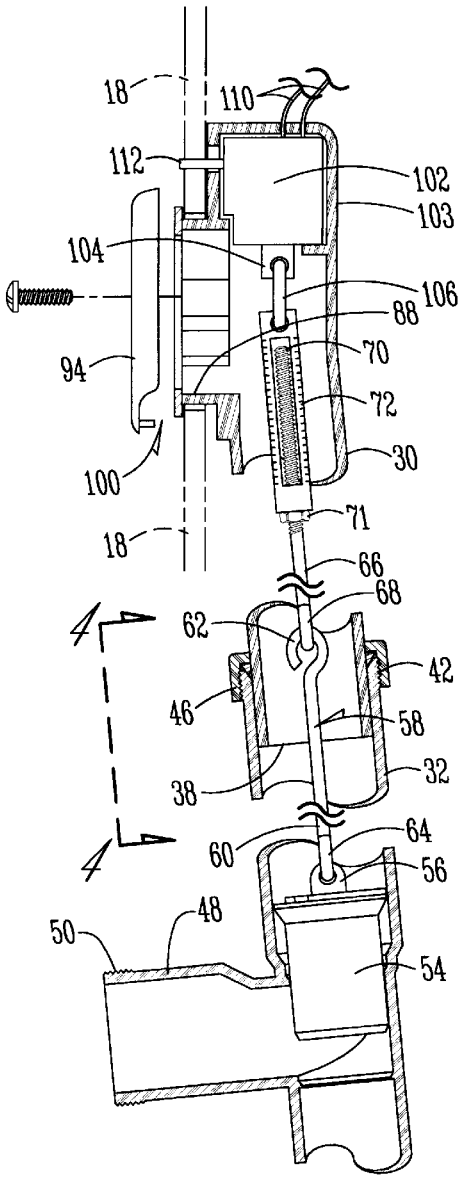
FIG. 3 is a sectional view similar to that of FIG. 2 but shows the valve in an open position.
Figure 4:
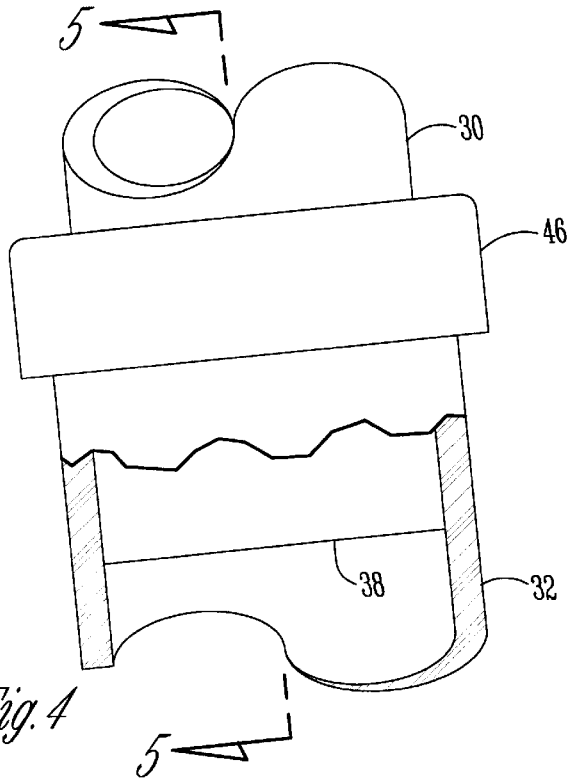
FIG. 4 is a n enlarged scale elevational view taken on line 4—4 of FIG. 3.

A valve element or drop cylinder 54 which is of hollow construction is slidably mounted in the vertical drain 28 within lower portion 32 (FIGS. 2 and 3). An ear 56 (FIG. 3) is secured to the upper end of valve element 54. Linkage 58 includes a lower link 60 which has a hook 62 on its upper end and a hook 64 on its lower end. Linkage 58 also includes a threaded link 66 which has a hook 68 on its lower end opposite the threaded upper end 70.

Figure 8:
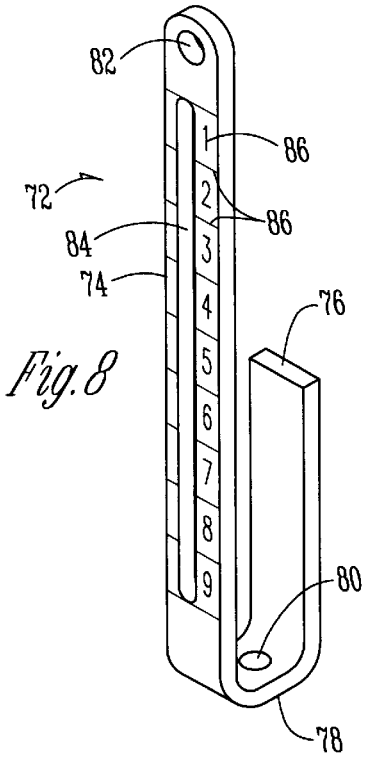
FIG. 8 is an enlarged scale perspective view of the gauge used in adjusting the length of the linkage systems.
Figure 7:
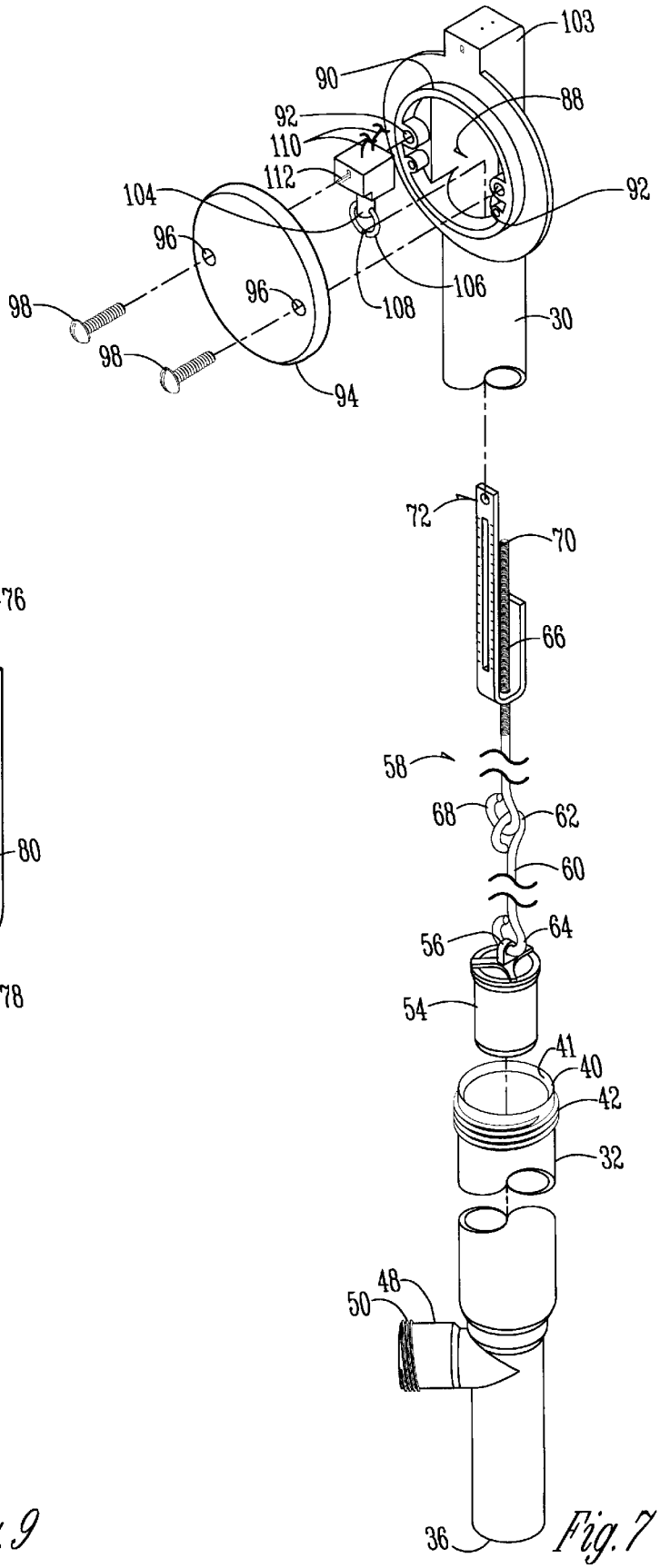
FIG. 7 is an exploded view of the various components of the invention.

Again, with reference to FIGS. 2, 3 and 7, a U-shaped gauge 72 having opposite legs 74 and 76 joined by a bottom 78. The threaded link 66 extends through threaded aperture 80 in the bottom 78. An aperture 82 (FIG. 8) appears at the top of gauge 72. An elongated vertical slot 84 is formed in gauge 72 with a plurality of spaced indica marks 86 appearing adjacent the slot (FIG. 8).

An upper port 88 is formed in the vertical drain pipe 28 (FIG. 6) and is encircled by flange 90. Screw sockets 92 are formed on opposite sides of the port 88.

With reference to FIG. 7, an overflow plate 94 has screw openings 96. Screws 98 extend through openings 96 and are received in screw sockets 92. A space for fluid flow 100 (FIGS. 2 and 3) is formed in overflow plate 94.

A solenoid 102 (in housing 103) with downwardly extending conventional spring loaded plunger 104 is mounted on the upper end 34 of pipe member 30 in any conventional manner. A ring 106 has a gap opening 108 and is mounted in a suitable aperture in the lower end of plunger 104. This permits the ring 106 to also be mounted in opening 82 in gauge 72. Solenoid 102 is connected to a source of electrical energy by wires 110 (FIGS. 2 and 3). A conventional switch 112 is on solenoid 102 to turn it "on" so that electrical power (battery or otherwise) can supply power to its conventional coil (not shown). Typically the conventional spring (not shown) in the solenoid 102 will hold the plunger in the upper position of FIG. 3 to open port 48. When the switch is closed, the plunger 104 is forced to the extended position of FIG. 2 which closes port 48.

To install the apparatus of this invention, the vertical distance between the center of the port 88 at the upper end of the vertical drain pipe down to the level of the waste water line 52 (FIG. 6) is measured. This measurement is useful for determining the overall assembled vertical length of the upper portion 30 to the lower portion 32 of the drain pipe 28. In addition, this dimension is also important in determining and adjusting the length of linkage 58 so that the valve member 54 will easily function between the lower position of FIG. 2 and the upper and open position of FIG. 54.

Figure 5:
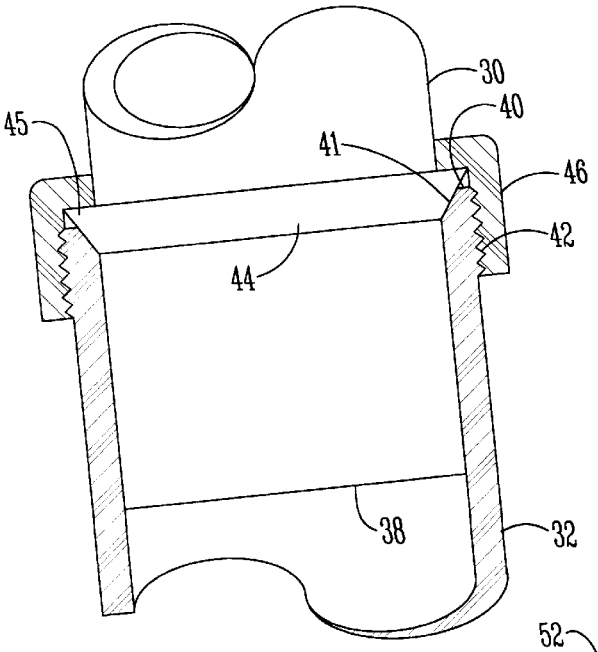
FIG. 5 is a sectional view taken on line 5—5 of FIG. 4.

The overall length of vertical drain pipe 28 is governed by the assembly of the upper portion 30 into the lower portion 32 in the manner described. This adjustment is accomplished by placing the seal 44 in the proper position so that when it rests within the upper end 40 of the lower portion 32, the vertical length will be correct. The juncture then between the portions 30 and 32, as best shown in FIG. 5 and as described above, can be implemented.

However, before this is accomplished, the dimension must be utilized in adjusting the overall length of the linkage 58. If the installer compares the existing unadjusted length of the linkage 58 to the measured vertical distance between the waste drain 52 and the center of port 88, and if the overall length of the linkage, including the gauge 72, is either long or short, the link 66 can be threaded through the limiting nut 71 which appears on threaded link 66. Nut 71 bears against the bottom 78 of the gauge 72 and determines the relative length of the portion of link 66 between bottom 78 and the cylinder 54. Thus, the cylinder 54 can be raised or lowered with respect to the gauge 72.

By removing screws 98, the cap 94 can be removed as shown in FIG. 7. This exposes the upper end and the aperture 82 of gauge 72 as it is pushed upwardly through portion 30. By utilizing the gap 108, in ring 106, the ring can be inserted through the aperture 82 at the top of the gauge, and the gauge and the linkage can be suspended from the ring 106. When the cap 94 is reassembled as described above, the linkage 58 is of a proper length and the assembled condition of vertical drain pipe 28 corresponds thereto.

To open the waste water port 48, the switch 112 is opened as shown in FIG. 7, because the solenoid spring will pull gauge 72 and the linkage and the cylinder 54 attached thereto from the closed position as shown in FIG. 2 to the open position shown in FIG. 3. As discussed above, a closed switch 112 will close port 48.

In the remote event that the water from water outlet 26 runs into the tub while the valve element 54 is in the closed condition of FIG. 2, water will rise within the tub 10 and will move into vertical drain pipe 28 through port 88 by entering the port through the passage 100 shown in both FIGS. 2 and 3. In that regard, the cap 94 in its spaced relationship from member 90 functions as a conventional overflow outlet. The water descends downwardly in that case through space 100 and vertical drain pipe 28 and moves through the hollow cylinder 54 to move vertically downwardly towards the bottom end 36 of portion 32 which is connected to a sewer pipe.

Figure 9:
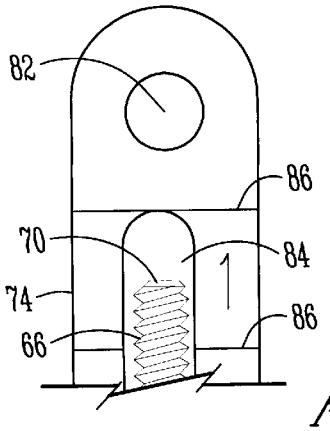
FIG. 9 is an enlarged scale perspective view of the top of FIG. 8.

The indica marks 86 on gauge 72 as best shown in FIG. 8, serve as a convenient guide for the installer to use in adjusting the length of linkage 58. Thus, if the top of the link 66 as shown in FIG. 9 needs to be raised approximately ⅛ of an inch, and if the vertical distance between indica marks 86 in FIG. 9 are ¼ inch apart, the installer can look through the slot 84 and visually observe the top 70 of link 66 and determine that the link has been rotated sufficiently to raise is ⅛ of an inch.

From the foregoing, it is seen that this invention provides a solenoid control for a bathtub waste water drain which is easy to install, refined in appearance, and fairly effective in its operation. As such, the objectives of this invention are fully met.

What is claimed is:

1. A control for a waste water drain in the bottom of a bathtub having an overflow fluid port above the drain in an end wall of a bathtub, comprising;

a vertical drain pipe having upper and lower ends, a first fluid port at the upper end of the vertical drain pipe, a second fluid port below the first fluid port for connection to a bathtub waste water drain, a valve element slidably mounted in the vertical drain pipe adjacent the second port and movable between a lower position to close the second port to fluid flow, and an upper position which will open the second port to fluid flow, an overflow cap mounted adjacent the first port, elongated linkage connected to the valve element so that the lifting of the linkage will raise the valve element to the upper position, and the lowering of the linkage will lower the valve element to the lower position, a solenoid having a reciprocally movable plunger operatively connected to an upper end of the linkage to selectively raise and lower the linkage to move the valve element to and from the upper and lower positions; and a solenoid actuator for controlling movement of the plunger and being positioned for access by a user in the bathtub.

2. The control of claim 1 wherein the vertical drain pipe is length adjustable.

3. The control of claim 1 wherein the vertical drain pipe is comprised of upper and lower portions that are detachably secured to each other.

4. The control of claim 3 wherein a lower end of the upper portion is slidably received within an upper end of the lower portion, and a rotatable nut detachably holds the upper and lower portions in locked relation to each other.

5. The control of claim 4 wherein a seal ring is slidably mounted on the lower end of the upper portion and is engagable with the upper end of the lower portion to seal the upper and lower ends of the lower and upper portions, respectively, together when the rotatable nut creates a locking relation to the upper and lower portions.

6. The control of claim 1 wherein the linkage includes a length adjustable gauge to permit the operational length of the linkage to be length-adjustable.

7. The control of claim 6 wherein the gauge includes an indicia bracket threadably mounted upon one end of a threaded link so that upon the installation of the control, threaded displacement of the link with respect to the gauge can be visually ascertained from indicia marks on the gauge.

8. The control of claim 7 wherein the gauge includes an elongated slot with indicia marks being located adjacent the slot, a threaded nut mounted adjacent to one end of the slot with one end of the link extending through the nut, and one end of the link being visible through the slot for permitting the amount of longitudinal displacement of the link to be visually ascertained by reference to the indicia marks and the one end of the link.

9. The control of claim 1 wherein the linkage has a pivotal connection between its upper and lower ends.

10. The control of claim 1 wherein the valve element is a cylinder slidably mounted in the vertical drain pipe.

11. The control of claim 10 wherein the cylinder is hollow so as to always permit fluid flow downwardly through the vertical drain pipe.

12. The control of claim 1 wherein the valve element is hollow so as to always permit fluid flow downwardly through the vertical drain pipe.

13. The control of claim 1 wherein a space exists between the cap and the first port so that fluid can pass through the space and the first port to the interior of the vertical drain pipe.

14. The control of claim 1 wherein the solenoid actuator is a switch.

15. The control of claim 1 wherein the solenoid plunger is aligned with the linkage.

16. The control of claim 1 wherein the solenoid plunger is raised to raise the linkage and value element and is lowered to lower the linkage and valve element.

17. The control of claim 1 wherein the solenoid is positioned above the linkage.

18. A drain closure control for a bathtub having a bottom drain and an end wall with interior and exterior sides, and a fluid overflow port in the end above the bottom drain, the control comprising:

a vertical drain pipe extending downwardly from the overflow port on the interior side of the end wall to a position below the bottom drain, a substantially horizontal drain pipe extending from the bottom drain to the vertical drain pipe and being in fluid communication therewith, a drop cylinder slidably mounted in the vertical drain pipe adjacent the juncture between the horizontal drain pipe and the vertical drain pipe and being movable between a lower position which closes the horizontal drain pipe, and an upper position which will allow fluid to flow through the horizontal drain pipe and thence downwardly into the vertical drain pipe, a single solenoid mounted adjacent the overflow port and having an extensible and retractable plunger for controlling opening and closing of the drain, elongated linkage connecting the drop cylinder and the solenoid plunger, whereby movement of the plunger in one direction will raise the drop cylinder to the upper position, and movement of the plunger in the other direction will lower the drop cylinder to the lower position, further comprising a solenoid actuator adjacent the overflow port for controlling extension and retraction of the plunger.

19. The control of claim 18 wherein the solenoid is positioned above the linkage.

* * * * *